US011344472B2

(12) United States Patent
Gordon

(10) Patent No.: US 11,344,472 B2
(45) Date of Patent: May 31, 2022

(54) TISSUE TREATMENT STICK

(71) Applicant: Beurer GmbH, Ulm (DE)

(72) Inventor: Christopher-Marc Gordon, Stuttgart (DE)

(73) Assignee: BEURER GMBH, Ulm (DE)

( * ) Notice: Subject to any disclaimer, the term of this patent is extended or adjusted under 35 U.S.C. 154(b) by 461 days.

(21) Appl. No.: 15/519,057

(22) PCT Filed: Oct. 12, 2015

(86) PCT No.: PCT/EP2015/073576
§ 371 (c)(1),
(2) Date: Apr. 13, 2017

(87) PCT Pub. No.: WO2016/058998
PCT Pub. Date: Apr. 21, 2016

(65) Prior Publication Data

US 2017/0216136 A1 Aug. 3, 2017

(30) Foreign Application Priority Data

Oct. 17, 2014 (DE) ..... 10 2014 221 116.6

(51) Int. Cl.
*A61H 15/00* (2006.01)
*A61H 23/02* (2006.01)

(52) U.S. Cl.
CPC ..... *A61H 23/0263* (2013.01); *A61H 15/0092* (2013.01); *A61H 2015/0014* (2013.01); *A61H 2015/0071* (2013.01); *A61H 2023/0272* (2013.01); *A61H 2201/0184* (2013.01); *A61H 2201/1253* (2013.01); *A61H 2201/169* (2013.01); *A61H 2201/1635* (2013.01); *A61H 2201/1645* (2013.01); *A61H 2201/1685* (2013.01); *A61H 2201/1695* (2013.01);
(Continued)

(58) Field of Classification Search
CPC ..... A61H 2015/0014; A61H 2015/092; A61H 2015/071; A61H 2023/0263; A61H 2023/0272; A61H 2023/0281; A61H 7/00; A61H 7/001; A61H 7/003; A61H 7/004; A61H 7/007; A61H 15/0092
See application file for complete search history.

(56) References Cited

U.S. PATENT DOCUMENTS 1,519,631 A * 12/1924 Sawtelle ..... A61H 15/0092 601/119
1,611,811 A * 12/1926 Brickey ..... A61H 15/0092 601/120
(Continued)

FOREIGN PATENT DOCUMENTS

DE 1904135 U 11/1964
DE 202014004900 U1 9/2014
(Continued)

*Primary Examiner* — Samchuan C Yao
*Assistant Examiner* — Nathan M Le
(74) *Attorney, Agent, or Firm* — Slater Matsil, LLP

(57) ABSTRACT

A tissue treatment stick is disclosed. In an embodiment, the tissue treatment stick includes a treatment section including a vibration generating device, wherein the vibrating generating device is configured to vibrate the treatment section, and wherein the treatment section has at least one edge, the at least one edge extending parallel to a longitudinal axis of the tissue treatment stick.

4 Claims, 14 Drawing Sheets

(52) U.S. Cl.
CPC ..... *A61H 2201/5061* (2013.01); *A61H 2201/5097* (2013.01); *A61H 2205/04* (2013.01); *A61H 2205/062* (2013.01); *A61H 2205/081* (2013.01); *A61H 2205/106* (2013.01)

(56) References Cited

U.S. PATENT DOCUMENTS 1,958,936 A * 5/1934 Bajette ..... A61H 23/0263 601/73
2,307,554 A 1/1943 Wettlaufer
2,547,115 A * 4/1951 Folley ..... A61H 15/00 601/119
3,067,738 A * 12/1962 Karlik ..... A61H 15/0092 601/120
4,210,135 A * 7/1980 Deuser ..... A61H 7/003 601/129
5,123,406 A 6/1992 Masuda
5,181,504 A * 1/1993 Ono ..... A61H 23/0263 601/57
6,135,972 A * 10/2000 Kuo ..... A61H 15/0092 601/119
6,419,650 B1 * 7/2002 Ryan ..... A61H 15/00 601/122
6,663,580 B1 * 12/2003 Adams ..... A61H 7/005 601/111
9,649,246 B1 * 5/2017 Johnson ..... F16B 7/10
9,700,480 B2 * 7/2017 Fiore ..... A61H 7/003
2003/0105417 A1 6/2003 Drake
2005/0202944 A1 * 9/2005 Deal ..... A63B 21/0004 482/126
2009/0054815 A1 * 2/2009 Briscoe ..... A61H 15/0092 601/134
2011/0245741 A1 * 10/2011 L'Homme ..... A61H 15/0085 601/120
2013/0012848 A1 1/2013 Forrest
2013/0178768 A1 * 7/2013 Dalebout ..... A61H 15/0092 601/46
2015/0165238 A1 * 6/2015 Slayton ..... A61B 18/1815 601/2
2015/0231014 A1 * 8/2015 Capobianco ..... B25F 1/00 601/135

FOREIGN PATENT DOCUMENTS

EP 0116113 A2 8/1984
EP 1925276 A1 5/2008
WO 2011034122 A1 3/2011
WO 2012003652 A1 1/2012
WO 2012117923 A1 9/2012

* cited by examiner

TISSUE TREATMENT STICK

CROSS-REFERENCE TO RELATED APPLICATIONS

This application is a national phase filing under section 371 of PCT/EP2015/073576, filed Oct. 12, 2015, which claims the priority of German patent application 10 2014 221 116.6, filed Oct. 17, 2014, each of which is incorporated herein by reference in its entirety.

BACKGROUND

For releasing muscular tension, massagers with two handles and a treatment section disposed between the handles have been known for decades. In said massage sticks the treatment section comprises a plurality of rollers arranged next to each other which are rotatably supported on an axle. At the ends of said axle, the handles are disposed. Said massager is gripped with both hands, and then the rollers of the treatment section are rolled over the muscle sections to be treated, thereby creating a certain massaging effect.

In particular, massagers are known from U.S. Pat. No. 2,307,554 A, EP 0 116 113 A2, US 2003/0105417 A1, DE 20 2014 004 900 U1 and DE 1904135 U.

SUMMARY

Embodiments provide a tissue treatment stick with improved effectiveness over a conventional massage stick.

Various embodiments provide a tissue treatment stick comprising at least two handles and a treatment section disposed between the handles, wherein means are provided for generating vibrations, wherein the means for generating vibrations cause the treatment section to vibrate and wherein the treatment section has at least one (treatment) edge.

As a result of the treatment section having at least one distinct edge, it is possible to momentarily generate a higher local pressure than when a roller rolls over the area or muscle section to be treated. In this way already a more intense effect and an effect reaching deeper into the tissue is achieved than with a massage. It has been found in studies that the tone of the tissue was significantly reduced even after a very short treatment time of a few minutes.

This effect is further enhanced by the oscillations into which the treatment section is set. This will also treat deep and not directly accessible areas of connective tissue and muscle, muscle fasciae or tendons and consequently these areas are relaxed and possibly existing adhesions or tangles of the fasciae, cramps, or so-called trigger points are resolved. Hereinafter, for reasons of linguistic simplicity the term "tissue" will often be used. This term includes connective tissue, muscles, muscle fasciae and/or tendons.

It has proved advantageous, that the means for generating vibrations cause the treatment section to vibrate with a frequency of less than 100 Hz, preferably of less than 60 Hz, and particularly preferably of less than 40 Hz.

When measuring the effectiveness of the treatment section of the invention, a particularly intensive and relaxing effect of the tissue treatment stick has been found at these relatively low frequencies.

In addition, the low frequency vibrations penetrate deeper into the connective tissue and the muscle tissue, so that for this reason, a low-frequency excitation of the treatment section is desirable as well.

In principle it is possible to generate the desired vibrations in various ways. A proven and suitable way for therapeutic purposes is to use an electrically driven vibration motor equipped with an unbalance. Such electrically driven vibration motors are available on the market in various designs. The desired frequency is set via the rotational speed of the vibration motor and/or a reduction gear. It is of course advantageously also possible to make the rotational speed of the vibration motor controllable, in order that the therapist can set the desired frequency depending on the application.

The effectiveness of the tissue treatment stick according to the invention can be further increased, if the means for generating vibrations produce a directed oscillating movement of the treatment section, wherein the direction of the oscillating movement preferably extends radially from a center point of the treatment section through a (treatment) edge. Because then the oscillating movements in the application of the tissue treatment stick act perpendicularly on the tissue to be treated and in this way unfold maximum therapeutic effect with minimal energy input.

If the treatment section comprises more than one edge, then in a further advantageous embodiment of the invention it is proposed that the oscillating movement can be directed to the direction of any one of the various edges.

In a treatment section having, for example, two or alternatively three edges, these are usually evenly distributed around the circumference in an angle of 180° or in the case of three edges of 120°.

If now in the case of a tissue treatment stick with three edges the possibility is provided for the treatment section to be rotated relative to the handles by 120° at a time, then any of the edges can be positioned in such a way, that the oscillating vibrations are directed precisely to the desired edge. It is assumed that the means for generating directed oscillating movement do not rotate relative to the handles during the adjustment. Thereby, the desired effect, namely the orientation of the oscillating movement directed at exactly one edge, is achieved in a simple manner. Of course, this applies analogously for a tissue treatment stick with two, four or five edges. Of course there are also further possibilities of alignment.

A directed oscillating movement can, for example, be achieved by two counter-rotating unbalanced masses being provided. In a first spatial direction the unbalances add up and in a second direction orthogonal to the first spatial direction, the unbalances cancel each other out. There are also other ways known to produce directed oscillating movement from a rotating unbalance.

It has proved to be advantageous if at least one edge consists of wood. Wood is perceived as very pleasant by a patient's skin. In addition, it is a very lightweight and durable material which may also be subjected to continuous vibration without causing material fatigue.

It has also proved to be advantageous to produce one edge of a rubber elastic material. In this way a very soft and gentle treatment of the tissue is possible. This edge is used primarily in the area of tendons, such as the Achilles tendon, or around the knee, where a relatively hard edge of wood might be perceived as painful by the patient.

It is further possible that at least one edge has ribs in order to form an even softer edge.

If, for example, three edges with different hardnesses and/or properties are arranged on a tissue treatment stick according to the invention, then the therapist or the self-user always has an edge available that is suitable for the body section to be treated.

It is also advantageous if at least one of the edges is exchangeable. Then, e.g., a worn edge can easily be replaced or the best suitable edge according to the different patients' needs can be inserted into the tissue treatment stick.

A further advantageous embodiment of the tissue treatment stick of the invention provides that in at least one of the handles a receptacle for batteries or accumulators is provided. Thus the power supply for the electrical vibration motor can be ensured in a simple manner. In addition, the relatively large mass of the batteries leads to the handles having large inertia of mass. Therefore, the vibrations of the treatment section are transferred only to a very small extent on the handles. It is thus possible that a therapist can work even for many hours a day with the tissue treatment stick according to the invention, without tiring and without having to fear circulatory problems caused by the vibrations.

In order to ensure that no forces too great are exerted with the edge on the tissue to be treated, at least one force sensor, but preferably two or more force sensors are provided, which detect the forces acting between the handles and the treatment section. If the forces exceed a predetermined threshold, a signal is (optical and/or acoustic) is activated, for example. Alternatively or additionally, it is also possible that the vibration motor is turned off in this case.

Thus improper treatment can be effectively prevented and medical laymen can also safely treat themselves with the tissue treatment stick of the invention.

In general it may be preferred to define an edge as follows:

An edge has a cross-sectional radius smaller by at least a factor of 3, preferably at least a factor of 5, more preferably at least a factor of 10, more preferably at least a factor of 15, than any radius of two sections directly adjacent to the edge-forming radius or directly adjacent to the edge.

While the circle provided by the cross-sectional radius in normal direction to the longitudinal direction of the tissue treatment stick overlaps the cross section of the tissue treatment stick, so in other words is located inside, this need not necessarily apply for the circles formed by the radii of the sections immediately adjacent to the edge-forming radius. The latter can in a further embodiment, in fact, not overlap the cross section of the tissue treatment stick, in other words, lie outside of it.

However, it is preferred to provide the cross-sectional contour of the treatment stick solely with circles overlapping or partially overlapping the cross-section. It is understood, moreover, that the transition from a contour formed by a radius to a contour formed by a dissimilar radius is not to be understood in a strictly geometrical sense, but also that a smooth transition at this point is to be understood within the scope of the above definition of the edge.

In further advantageous embodiments it is provided that the tissue treatment stick and more particularly the treatment section can be adapted to the body shape to be treated. The adaptation to the body shape can, e.g., refer to parts of the body such as the neck or the shoulder area of the user or the patient. The adaption of the treatment section can be provided completely or partially.

An advantage of this adaptation is that regions of the body, with the same duration of treatment, with a larger surface can be treated, than with a treatment section formed straight. For example, in the back or coccyx region a section convex to the body surface, i.e. curved outwards, within the treatment section is of advantage. This convex shape may be located centrally in one embodiment, wherein two sections adjacent to both ends of the convex section in turn can be straight. In another embodiment, the sections adjacent to both ends of the convex section can be concave with respect to the body region to be treated, i.e. be formed curved inwards, in order to treat faster and more thoroughly body regions extending transversely to the backbone region extending laterally.

Furthermore, the sections referred to can by themselves or, if one or two handles are provided, lie on one axis or—in a different embodiment—form an angle whose vertex can also be outside of the treatment stick.

The above-mentioned adaption can be further realized, for example, in that an in particular central section of the treatment section or the entire treatment section is curved, in particular circularly curved.

In one embodiment, there are at least the two handles on a common central axis and the intermediate treatment section is along its length, for example, circularly curved or curved similar to a half sine wave function. The transitions of the sections positioned around a central axis, in particular of the handles to the longitudinally curved treatment section can be smoothly formed. An immediate stepped transition between these sections is also provided as an alternative embodiment.

In another embodiment the entire stick, i.e. together with the two outer handles, can be formed curved. The curve can be embodied by successive sections of different radii. Alternatively it can be formed by a single curve radius.

In a further embodiment the treatment stick can be curved in different directions. Thus the invention provides, for example, in one embodiment, that the two handles are curved from an imaginary center axis of the treatment stick toward the user and a middle section of the treatment section or the whole treatment section of the treatment stick is curved away from the user.

In all embodiments the treatment stick is preferably formed laterally symmetrical, i.e. the left side and the right side of the treatment stick are in their outer shape substantially or actually identical.

In one embodiment may also be provided that the treatment stick has one, in particular a single one, handle and the treatment section is arranged additionally or by itself on an end opposite to the handle.

In this embodiment, it is provided that the treatment stick is curved at the end forming the treatment section. The curve is preferably formed like in a walking stick. The arc caused by the curve spans an arc angle of preferably between 80 and 320 degrees. An edge of the treatment section is further formed on the end surface of the treatment section. Alternatively, the treatment section at this point can, however, also have a non-edge-shaped configuration, such as pyramidal, conical or frusto-conical or part-spherical shaped.

In another embodiment, it is further provided that at least the treatment section of the treatment stick is manually changeable in its shape and can in this respect be changed by the user to the desired shape for treatment.

One aspect of the above embodiment may include a pivot function that allows parts of the treatment stick to be rotated against each other, in order to achieve via a joint different angles of the treatment section toward one or two handles, thereby enabling successful treatment for hard to reach places, such as the back region. Furthermore, the treatment stick may by way of such joints, particularly by joints lockable in several angles, be folded up compactly, e.g., for easier transport or travel or for small-scale storage of the treatment stick.

In a further embodiment a treatment section is proposed that has one or more exchangeable parts. These exchangeable parts are lockable, for example, by simple snap-in units in the base body of the treatment stick. On the one hand the exchangeability of parts of the treatment section allows for ease of cleaning, e.g., removal of oils and therefore improved hygiene. On the other hand, parts of different sizes, in particular of various diameters and/or various materials can be used, whereby a massage treatment will be individualized by the corresponding modification of the treatment stick.

If in a further embodiment the handles are also changeable, e.g., with simple snap-in or screw connections, different sizes of handles for differently sized hands can be used in a treatment stick.

In addition to the size of the handles, form and material may also have a special configuration. Thus according to one embodiment, the handles can be formed padded, in particular by means of a foam material. The attachment of the handles to the treatment stick may, for example, be by means of plugging, screwing or latching.

In one embodiment it is provided to provide a decoupling device between the handles and the treatment section, which dampens or completely decouples the vibration and/or oscillating motion of the treatment section from the handles. Such a decoupling unit may be provided, for example, as a spring unit, such as a torsion spring.

In another embodiment, it may further be provided that at least the treatment section is fitted with an antibacterial and/or anti-fungal coating. Such a coating may comprise, for example, nano-silver, whose antibacterial effect is sufficiently well known.

In a further embodiment, there may further be provided that the vibration is supplemented or replaced by further motion functions. For example, the treatment section may be equipped with a tap function. The implementation of a mechanism that can perform such a tap function is sufficiently well known. As only one example a spring unit driven by a gear and thus cockable is mentioned, which after a predetermined time or a preset adjustment force impulsively decocks and operates a hammer unit that beats or taps on an anvil unit. The tap frequency can be fixed or alternatively varied by means of a controller. A tap frequency between 0.5 and 10 Hz is preferred in this case. The tap frequency may be provided in a modulated way and spread over the frequency range one or several times. Further, the tap intensity, that is, the amplitude of motion in a preferred embodiment of the treatment stick may be modulated as well. It should be understood that the aforementioned units are preferably arranged in a cavity of the treatment stick.

Provided that the treatment stick is flexible, in a further embodiment, another mechanism may be provided, which allows for a kneading function of the treatment stick, in particular for its treatment section. This kneading function may be in a simple case a reciprocating motion or a partial or complete rotation of a stick section that is accompanied with a certain change in shape of the respective section, in particular of the treatment section. As a simple example, a rotatory movement of a connecting rod unit shall be mentioned, which is arranged in a flexible sheath. Within one full rotation of a drive such a connecting rod will result in extended state in a corresponding bulge of the sheath wherein a simple kneading function is achievable, which may supplement or replace the vibration massage.

In a further embodiment it is further provided that the oscillation generator is formed as a piezo unit. Besides piezo actuators also other known electrical or electromechanical oscillation generators are suitable in principle. Only as an example and without limitation, preloadable spring units, thermally actuated vibration generation devices, internal combustion engines for generating oscillation can be used in a generally known way.

In one aspect, it may furthermore be provided to position one or more identical or different oscillation generators in the treatment stick. Apart from a central position the oscillation generator or the oscillation generators may also be distributed in the direction of the left and right halves of the stick, therein either in an equidistant spacing from one another, or with different distances.

It may also be provided as a further an embodiment, that a magnetic field is generated as a permanent field or an alternating field, in particular in the area of the treatment section that acts on the body region to be treated. For a permanent magnetic field, a permanent magnet may be used in a simple case, which is mounted in or on the treatment stick.

As a further embodiment, a light emitting device that supports the massage effect may be provided. For example, infrared light, red or blue or green light with the corresponding LED or other known light sources can be used.

Preferably, a part of the treatment section is formed as a translucent section, which allows the passage of light. The translucent section may be formed, for example, as one of the aforementioned treatment edges, and thus extend over the entire length of the treatment section of the treatment stick. It is also possible to provide the area between the edges of the treatment section with a translucent section. The translucent section is preferably made of glass or glass substitutes. In particular for smaller sections rock crystal or similar translucent rocks are suitable. By supplementing the treatment stick with light sources, for example, heat can support the massaging effect or when using red, blue, green or white light, a positive therapeutic effect may be applied particularly to the treated body region.

In a further embodiment it is also provided that the treatment section is heated by at least one heating unit. As a heating unit heating wire or heating foil is suitable. The heating units can—for example, with a layer of lacquer—be covered and isolated from external influences.

As particularly positive for supporting a massage effect, acoustic support has been found by means of a speaker integrated in or on the treatment stick. This speaker can be operated with audio waves in the frequency range of preferably below 100 Hz, more preferably below 60 Hz, even more preferably below 40 Hz.

Below the audible frequency range, approximately from 16 Hz to 21 Hz a positive support of the massage effect can also be shown, which is why this frequency range can be provided in a further embodiment.

In one aspect, therefore, a frequency band can be used which extends into the non-audible frequency range, or overlaps this range. In another aspect the desired frequency is adjustable, particularly infinitely variable, or various programs can be played from a saved program selection. It is understood that conventional music/radio drama/or meditation pieces are playable by means of the at least one speaker. These audio tracks can be transferred in a further aspect to the treatment stick from other devices, such as smartphones, via a USB socket provided on the treatment stick.

In another aspect, it is further provided that by means of a socket present in the treatment stick, smart phones and other hand-held devices can be charged.

Via such a socket furthermore massage measuring data, which may, for example, be stored by a memory device of the treatment stick, are also retrievable. Such massage data include, for example, and are not limited to, the duration of treatment, the selected treatment program, and if a corresponding sensor is present in the treatment stick, the treated body regions. In addition to or instead of the USB port other means can also be provided in the treatment stick for communication with other devices, such as an infrared interface, or devices for ultrasonic, optical or radio communication. Communication between the treatment stick and another device such as a smartphone, for example, can concern user-created massage programs that the user may want to share with other users. Furthermore issues of applications in different languages are possible using the communication channels made available. In particular, device pairing between the treatment stick and a further device can be provided by means of which live communication is optionally possible.

In another aspect, in one embodiment a timer function for the treatment stick is provided, by means of which the user turns off the treatment stick after exceeding a preset treatment time, such as a total treatment time, or a recommended treatment time for certain parts of the body, or outputs an acoustic or optical warning signal.

It is understood that to the treatment section having at least one edge other sections may adjoin having no edge and which can be formed as a rotatable roller, rotatable ball, rotatable triangle or in other forms suitable for massage.

Further advantages and advantageous embodiments of the invention are available in the following drawings, their description and the patent claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF ILLUSTRATIVE EMBODIMENTS

Figure 1:
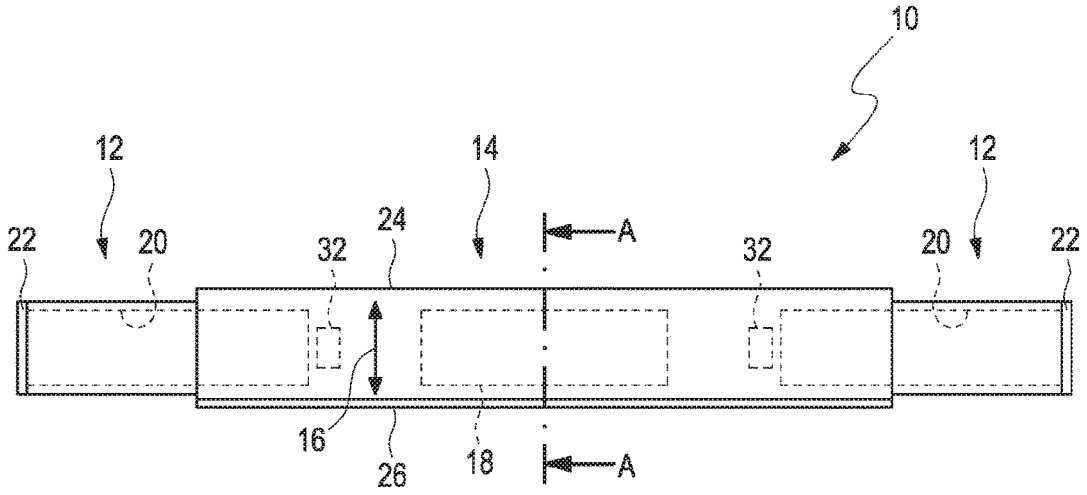
FIG. 1 shows a side view of a tissue treatment stick according to the invention.

FIG. 1 shows a schematic view of a tissue treatment stick 10 according to the invention. At its ends, the tissue treatment stick has two handles 12. A treatment section 14 is formed between the handles 12. As indicated by an arrow 16, it is possible to cause the treatment section 14 to vibrate in an oscillating or rotating manner. This vibration is generated by means for generating vibrations 18, which are usually formed as an electric motor with an unbalance. To ensure the energy supply of this electric motor, receptacles 20 for accumulators or batteries are formed in the handles 12.

The receptacles 20 can be opened and closed using a simple, preferably toollessly mountable and removable cover 22. It is thus possible, similar to an electric torch to replace the batteries in the shortest possible time and put them in a loading station (not shown). During the charging process, a second set of batteries can be inserted into the tissue treatment stick 10 so that it can be operated for an almost infinitely long time.

It is of course also possible that the batteries are charged while in the receptacles 20 by an external charging cable. The required socket is not shown in FIG. 1.

The electrical leads from these receptacles 20 to the means for generating vibrations 18 are not shown in the schematic view of FIG. 1. Furthermore, an on/off switch, displays such as a visual warning signal (LED or display), which is output when the force applied on the tissue is too large, are not shown in FIG. 1.

In FIG. 1 force measuring devices 32 are shown schematically, which detect the forces acting between the handles 12 and the treatment section 14. If a permitted limit is exceeded, then an acoustic and/or optical signal is generated. Alternatively, it is also possible to disable the vibration motor 18 in this case. Thus unacceptably high forces can be effectively prevented and it is avoided, that the patient has bruises or other ailments on the day after treatment.

Figure 2:
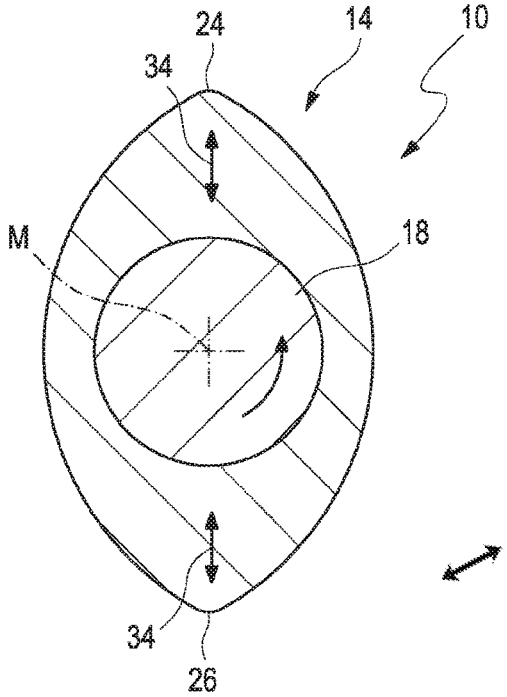
FIGS. 2 and 3 show various embodiments of the tissue treatment stick according to the invention.

In FIG. 2 a cross section along line AA according to FIG. 1 is shown. In this embodiment, the treatment section 14 has two opposed edges 24 and 26 which are connected to each other by a circular arc in the cross-sectional view of FIG. 2. The edges 24 and 26 are rounded slightly and have no sharp edges, because the tissue to be treated is stroked with the edges 24 and 26 of the treatment section 14. Treatment with an edge that is too sharp would be perceived as painful by the patient and could even cause injury. A radius of 2 mm to 8 mm as the minimum radius of curvature at the edges 24 and 26 has proved to be advantageous. The edges are preferably essentially or completely parallel to a longitudinal axis ii of the tissue treatment stick. At least in the area of edge 24 the treatment section 14 is preferably made of wood, partly because wood is perceived by the patient as comfortable. In addition, wood is a lightweight, highly efficient material that shows no fatigue during extended use, even if it is acted upon hundreds of hours with vibration.

The edge 26 can be used in the treatment section 14, and consists in a further embodiment preferably of a rubber-elastic material. This rubber-elastic material is much softer than the wood on edge 24. Therefore, edge is 26 particularly suitable for the treatment of regions that have little connective tissue or muscle mass. For example, the Achilles tendon or the region around the knee can be treated well by using the edge 26.

In FIG. 2, the means for generating vibrations 18 are shown. The curved arrow (unnumbered) is intended to indicate the circumferential unbalance of a vibration motor.

Figure 3:
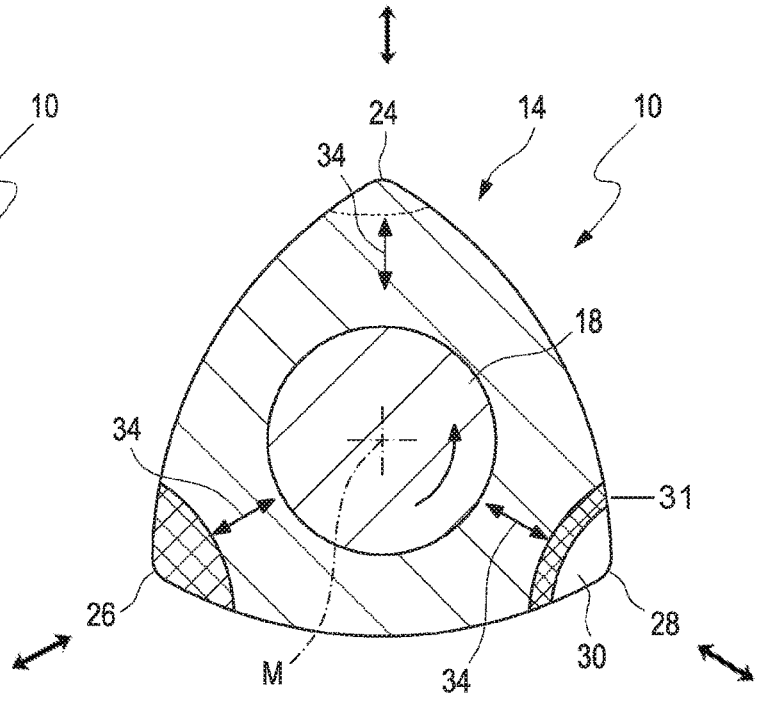

FIG. 3 shows a further exemplary embodiment of a treatment section 14 according to the invention. In this embodiment, the treatment section 14 is in the manner of a trochoid, and has three edges 24, 26 and 28. The edges 24 and 26 can be formed just as explained with reference to FIG. 2.

The third edge 28 may, for example, be formed as a exchangeable edge made from a rubber-elastic material having a base 31 and a plurality of ribs 30, which make the edge 28 even softer and more flexible.

In FIGS. 2 and 3 an embodiment is indicated by arrows 34, in which the treatment section 14 is brought into oscillating movement, wherein said oscillating movement has a direction which, starting from a center point M of the treatment section 14 is directed radially outward to one or in the case of FIG. 2 toward both edges 24 and 26 respectively.

If an oscillating motion is imparted on the treatment section 14, then a maximum depth effect of the treatment is achieved with minimal energy input. It is particularly advantageous in this case if two edges 24, 26 are arranged opposite to each other, because then by simply turning the tissue treatment stick 10 according to the invention by 180° the desired edge 24 or 26 can be used. In this case it is not necessary to change the direction of the oscillating movement.

The situation is different in the embodiment according to FIG. 3. In this embodiment, if a directed oscillating movement 34 is imparted on the treatment section 14, then it is recommended that if this direction, starting from the center M radially outwards, can be directed to either one of the edges 24, 26 or 28. This can easily be achieved by the treatment section 14 being rotated relative to the handles and the means for generating a directed unbalance 18 by 120° when another edge is to be used.

In FIGS. 4 to 8 various further alternative embodiments of a tissue treatment stick 10 according to the invention are shown, each with a sectional view through a body section 28 to be treated of a user.

Figure 4:
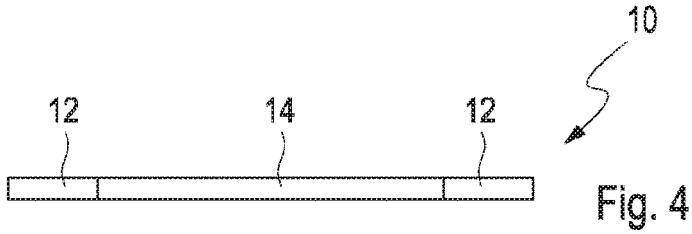
FIGS. 4-8 show various other alternative embodiments of a tissue treatment stick according to the invention with one cross-section each of a body section of a user to be treated.

FIG. 4 shows a completely straight stick 10 having two handles 12 and a treatment section 14 extending in between.

Figure 5:
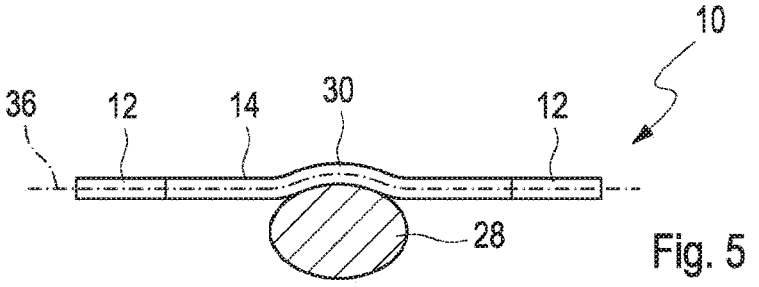

In FIG. 5 the treatment section 14 is located on a central axis 36 except for a central section 30. The handles 12 are also located on the axis 36. The central section 30 is curved and is formed concave with respect to a body section 28, in this case a thigh.

Figure 6:
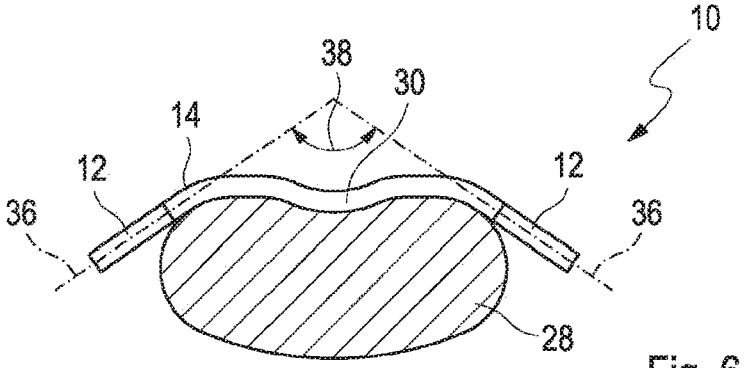

In FIG. 6 the treatment section 14 is located, except for a central section 30, on two axes 36, which span an angle 38. The handles 12 are also located each on one of the axes 36. The central section 30 is curved and is with respect to a body section 28, in this case a back region, formed convex.

Figure 7:
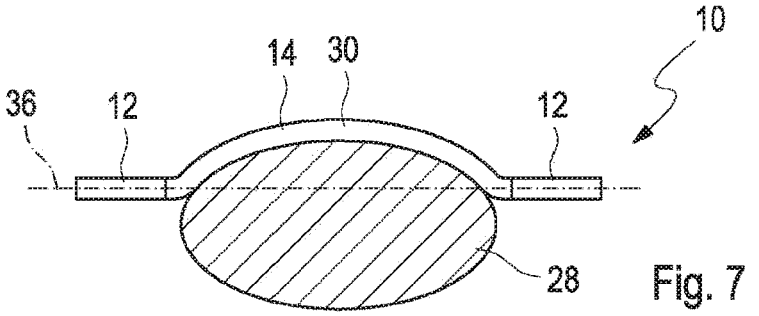

In FIG. 7 the entirely curved treatment section 14 is no longer on the axis 36 but arches relative to a body section 28.

Figure 8:
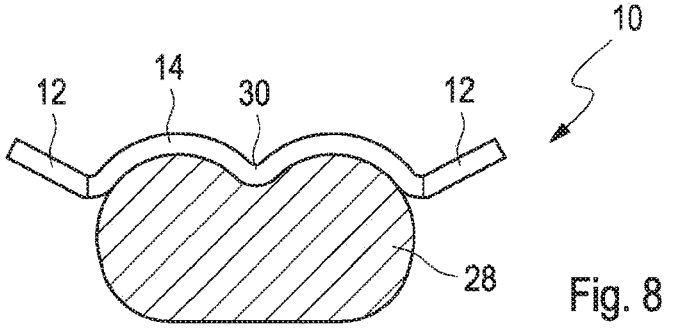

In FIG. 8 the symmetrically formed treatment section is curved in a central section curved opposed to the central curved section 30 at both its end sections. The handles 12 are substantially bent with respect to the treatment section 14. This treatment stick is suitable for the treatment of a coccyx or back region shown as body section 28.

Figure 9:
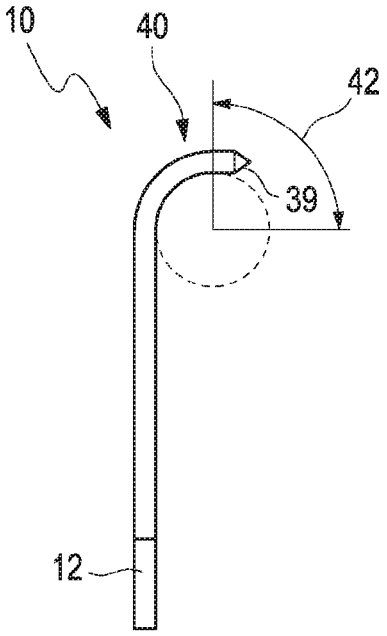
FIGS. 9 and 10 show further embodiments of a treatment stick having a handle.
Figure 10:
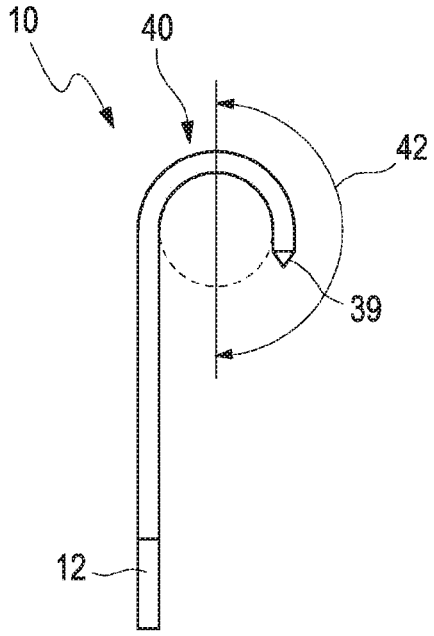
Figure 11:
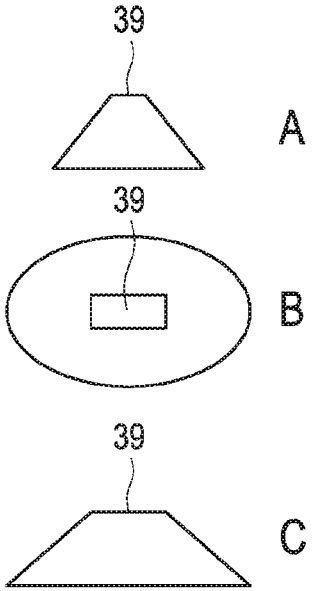
FIGS. 11-13 show views of a font side treatment section of a treatment stick according to FIGS. 9 and 10.
Figure 12:
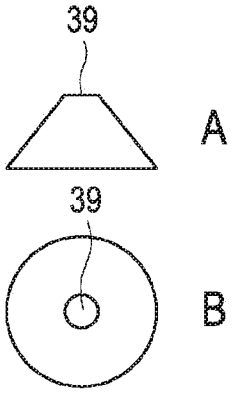
Figure 13:
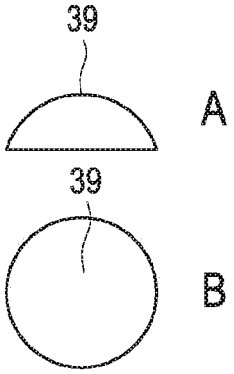

FIGS. 9 and 10 show further embodiments of a treatment stick 10, in this case having only one handle 12. The front side 39 opposite handle 10 is shown in FIGS. 11 to 13 in various configurations, which should not be interpreted as limiting. The treatment stick bends with its end section 40 having a front side 39 in FIG. 9 by an angle 42 of approximately 90 degrees. In FIG. 10 the end section is bent in an angle of 180 degrees. With such treatment sticks, treatment of the back can take place without the treatment stick having to be positioned over across the shoulder. In the straight treatment section adjacent to handle 12 the treatment sticks 2 shown in FIGS. 9 and 10 have edges running parallel to the longitudinal axis of the treatment stick, which are not shown here.

FIGS. 11 to 13 are views on front sides 39 of end sections, as discussed in FIGS. 9 and 10. In Figure ii views A and B each show a side view and view C shows a top view on a front side 39, which in this case is formed as projecting from an oval base.

FIG. 12 shows a top view with view A and a side view with view B on the frusto-conical end of the end section 40 of a treatment stick according to FIGS. 9 and 10.

FIG. 13 further shows a part-spherical front side 38 of end section 40 according to FIGS. 9 and 10, wherein view A shows a side view and view B shows a top view of the front side 39.

Figure 14:
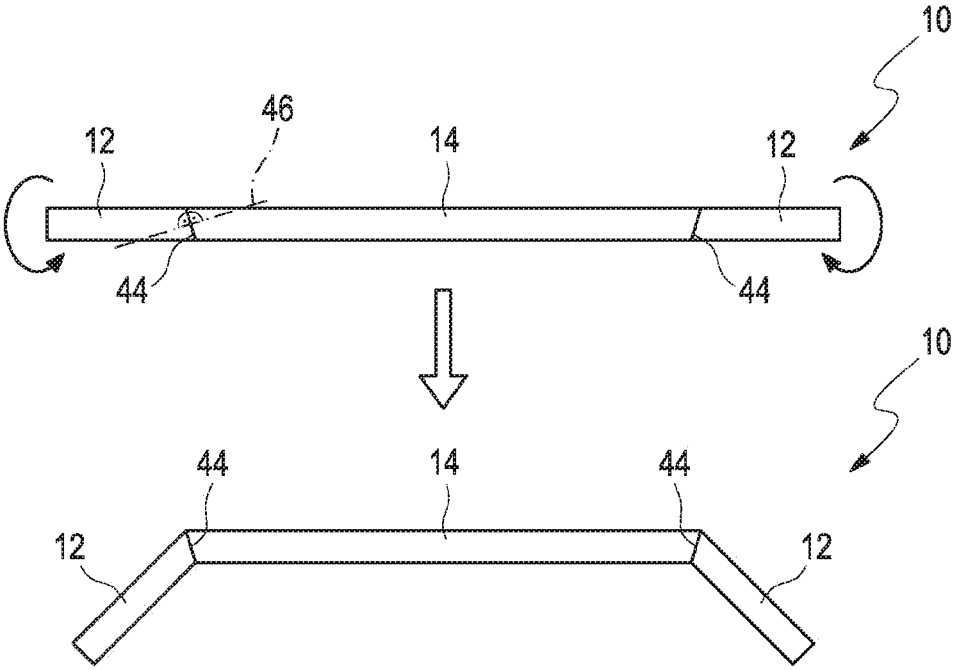
FIGS. 14 and 15 show treatment sticks having sections variable in position relative to each other.
Figure 15:
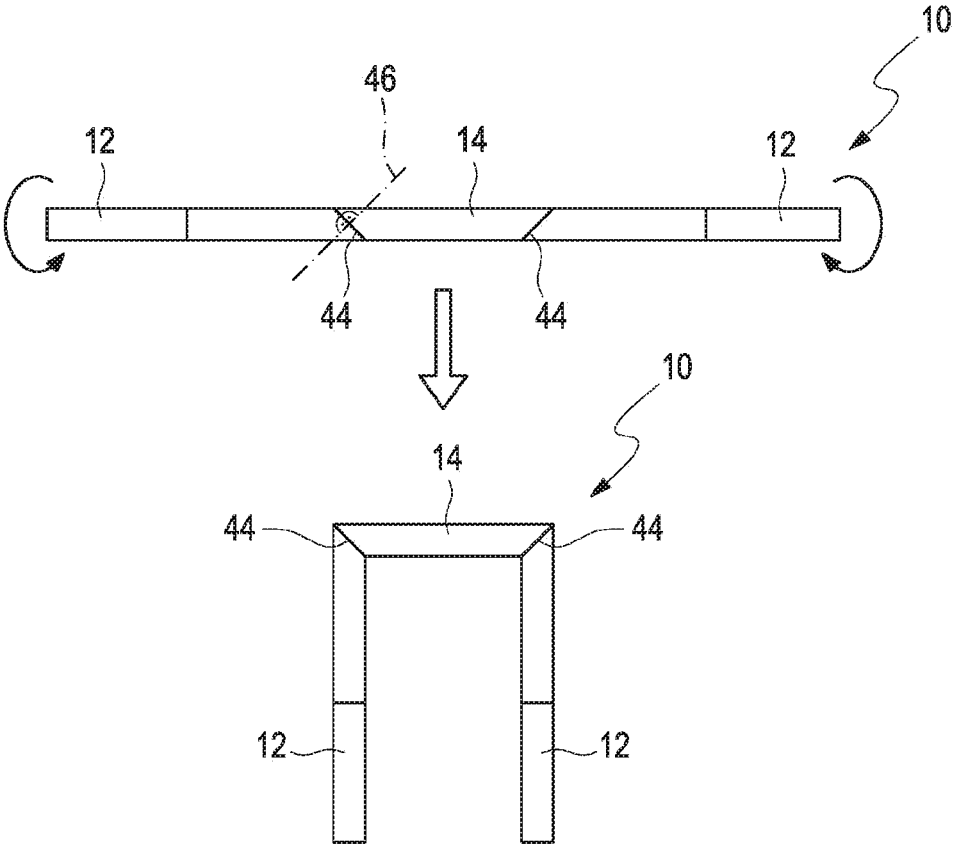

In the case of the embodiments of a tissue treatment stick 10 shown in FIGS. 14 and 15, a rotation function is present, with which parts of the treatment stick 10 can be rotated against each other about a rotational axis 46, in order to achieve via two joints 44 different pitch angles of the treatment section 14 relative to two handles 12 and thereby allow successful treatment for hard to reach places, such as the back region. Furthermore, the treatment stick 10 can be folded by such, particularly lockable in several angles, joints 44 in a compact manner, for example, to allow for easier transport or travel or for small-scale storage of the treatment stick, as shown in FIG. 15 at the bottom.

Figure 16:
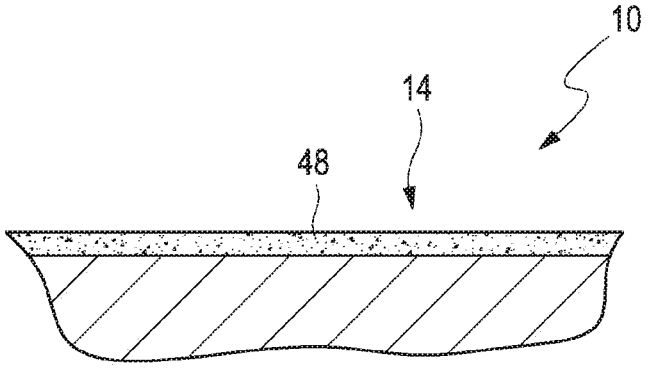
FIG. 16 shows a detail of a sectional view through a treatment stick.

FIG. 16 shows a detail of a sectional view through a treatment stick, namely a coating with a plastic material 48 having nano-silver particles on a treatment section 14. As is known, by way of this the adhesion of pathogens, particularly to the treatment section 14, can be made more difficult or prevented entirely.

Figure 17:
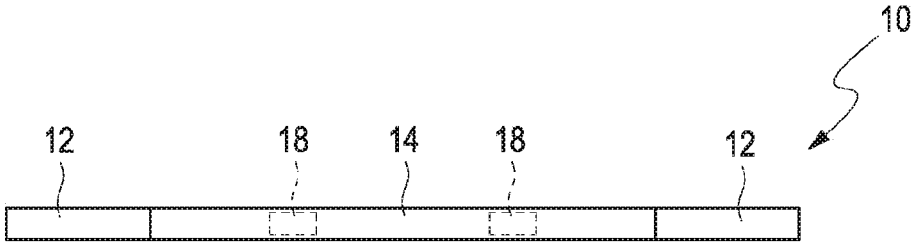
FIGS. 17 and 18 show different arrangements of vibrating units within a treatment stick.
Figure 18:
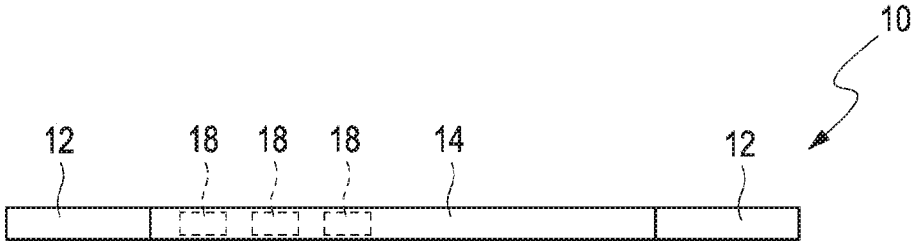

FIGS. 17 and 18 show different arrangements of vibrating units in the form of two or three vibration motors 18 within a treatment stick. In FIG. 17 a symmetrical arrangement of the vibration motors 18 is shown and in FIG. 18 a non-symmetrical arrangement of the vibration motors 18 is shown, wherein three vibration motors are located on the side of the tissue treatment stick 10 shown here to the right.

Figure 19:
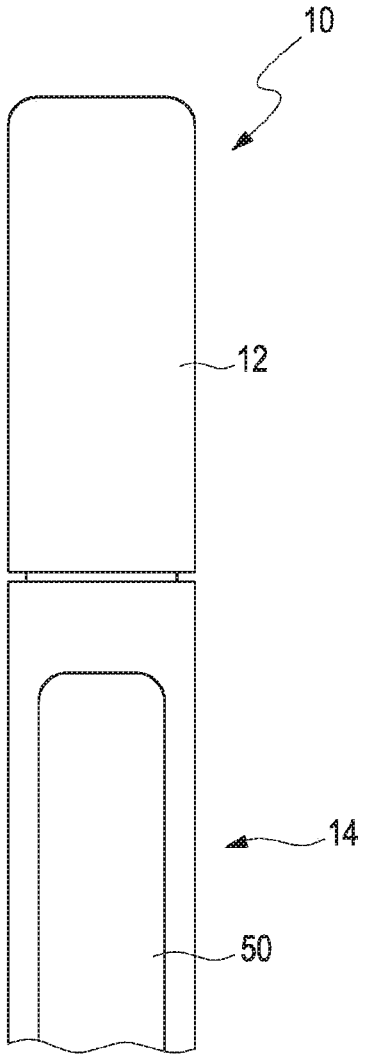
FIGS. 19-21 show in each one an arrangement of a translucent section within a treatment section of the treatment stick.

FIG. 19 shows an arrangement of a translucent section within a treatment section 14 of a treatment stick 10. The translucent section is made of plastic material and extends only over part of the treatment section 14. A light source not shown here emits UV light through the translucent section 50.

Figure 20:
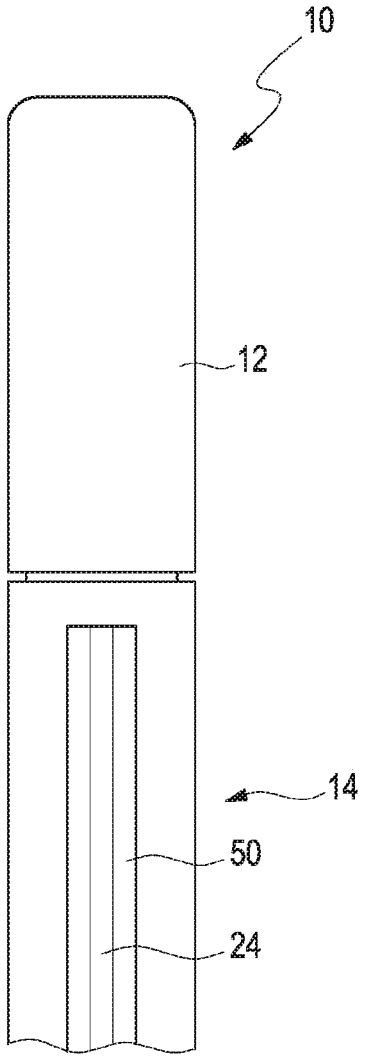
Figure 21:
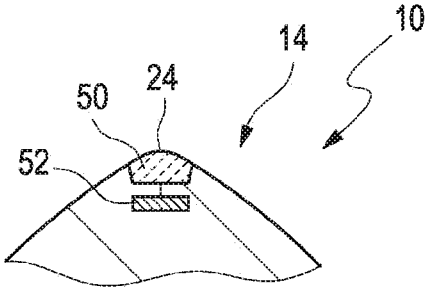

FIGS. 20 and 21 show in different views a further arrangement of a translucent section 50 within a treatment section 14 of a treatment stick 10. The translucent section is formed of glass material and extends almost entirely along the treatment section 14 and forms part of said treatment section. An edge 24 is formed by the glass material used. A light source 52 emits infrared light through the translucent section 50.

Figure 22:
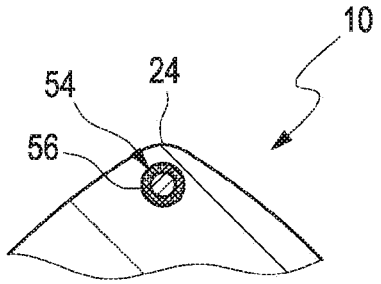
FIGS. 22 and 23 show in each one an arrangement of a heating unit within a treatment stick.
Figure 23:
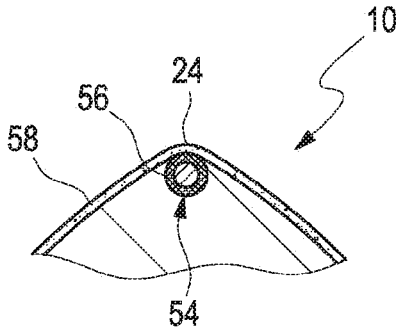

FIGS. 22 and 23 each show an arrangement of a heating unit 54 in the form of a known heat conductor underneath an edge 24 within a treatment stick 10. In FIG. 22, the heat conductor is placed in a designated passage opening and in FIG. 23 an insulation 56 of the heat conductor is located directly on a protective layer 58 of lacquer and forms an edge 24 with said layer.

Figure 24:
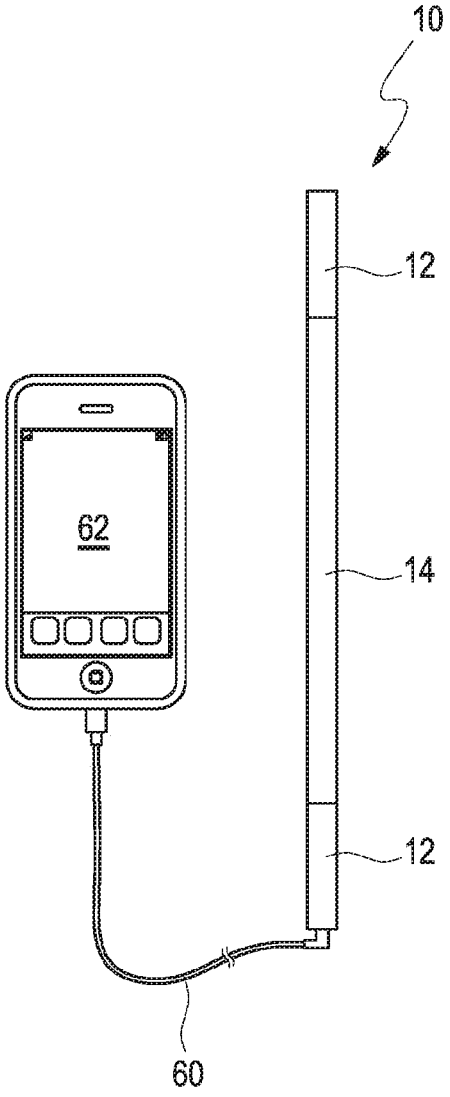
FIG. 24 shows a treatment stick connected to a hand-held device.

FIG. 24 shows a treatment stick 10 which is connected by a USB connector 60 to a hand-held device 62 in the form of a smartphone. The USB connector 60 allows not only for transmission of data but also charging of an accumulator existing in the treatment in stick 10 not shown here.

Figure 25:
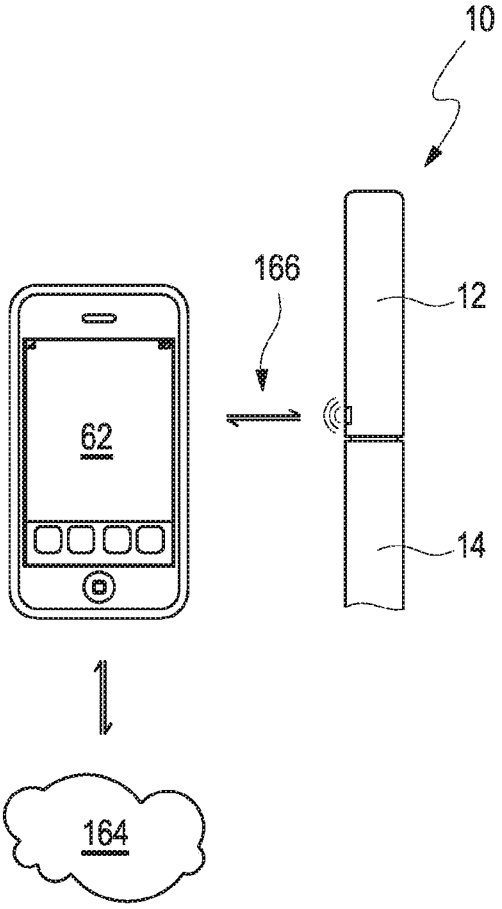
FIG. 25 shows a treatment stick having a wireless communication interface.

In FIG. 25 a treatment stick 10 communicates via a hand-held device 62 with an Internet cloud 164. For this purpose, a communication interface 166 is provided in the form of a WLAN connection.

Figure 26:
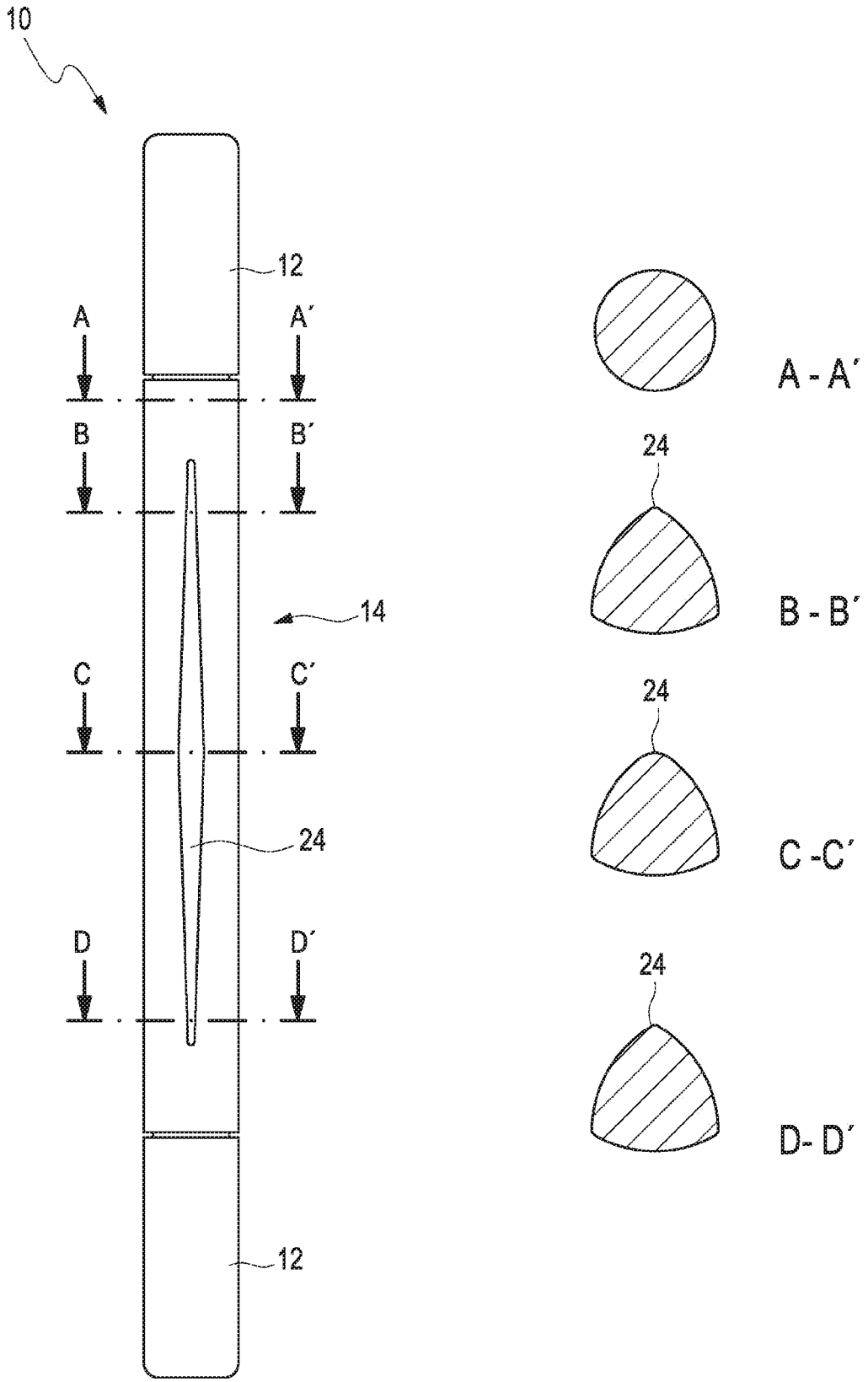
FIG. 26 shows a further treatment a stick having an edge completely rounded on both sides.

FIG. 26 shows a further treatment stick 10 with an on both sides completely rounded edge 24. The edge 24 itself has in the center of the stick (section C-C') a radius of 7 mm and in an end area (section B-B') has a smaller radius of about 2 mm and/or has at the end (section A-A') no edge radius differing from the radius of the treatment stick. The radius reduction is linear on both sides starting from the center (section C-C').

Figure 27:
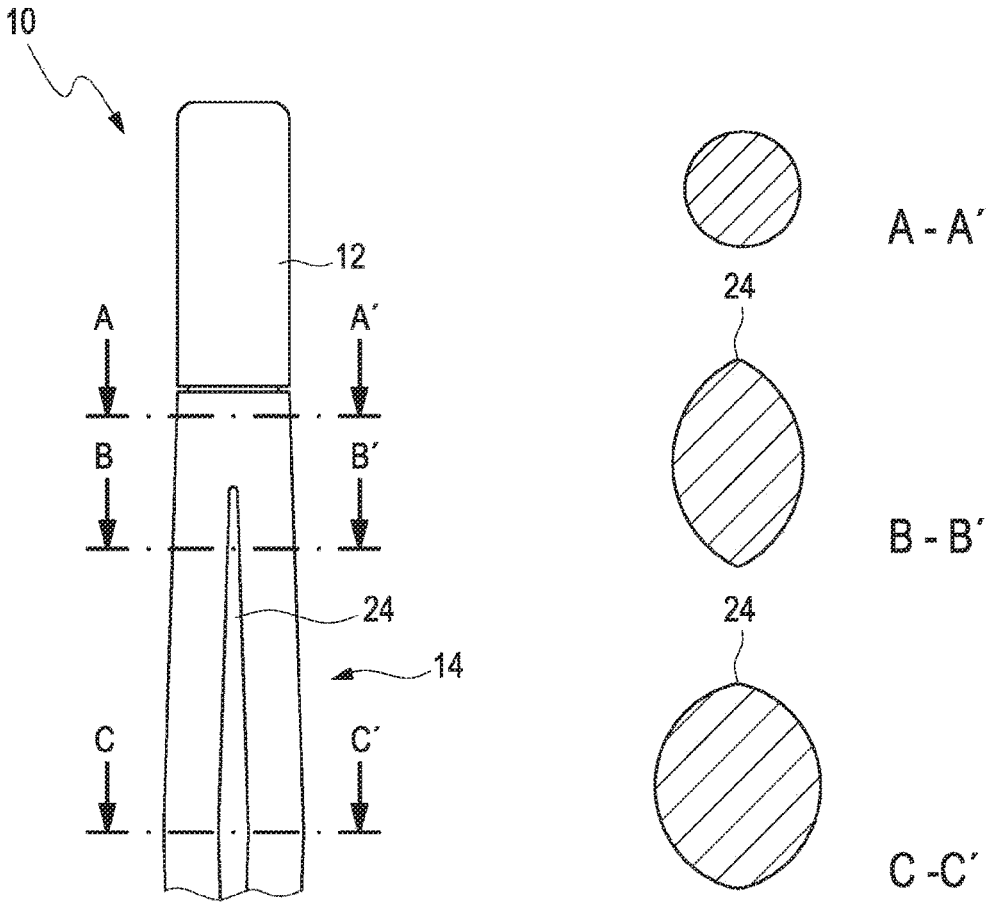
FIG. 27 shows a further treatment stick having an edge rounded on both sides.

FIG. 27 shows another treatment stick 10 with a partially oval cross-section having an on both sides completely rounded edge 24. The edge 24 itself has in the center of the stick (section C-C') a radius of 25 mm and thus transitions into the basic shape of cross-section of the stick. In one end section (section B-B') the edge has a smaller radius of about 3 mm. The radius reduction is linear on both sides starting from the center (section C-C').

Figure 28:
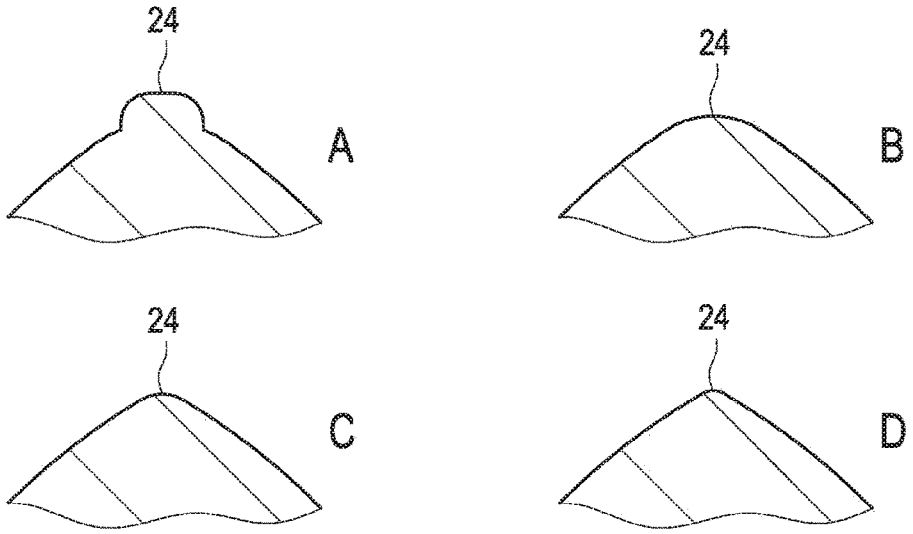
FIG. 28 shows various edge shapes, each in a sectional view.

FIG. 28 shows various edge shapes in a sectional view, therein the edge 24 forms a projection in view A, in views B, C and D the edge 24 has a radius of 8, 4 and 2 mm.

Figure 29:
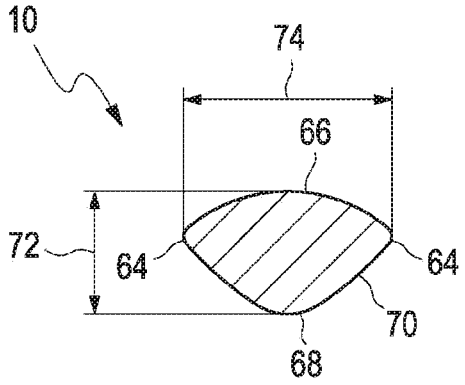
FIGS. 29-31 show different cross sections through a treatment stick.
Figure 30:
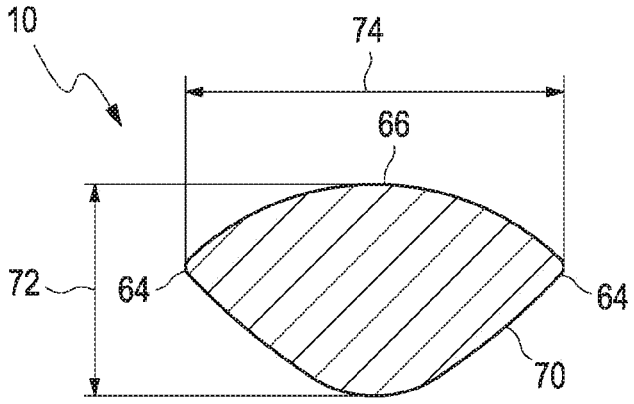
Figure 31:
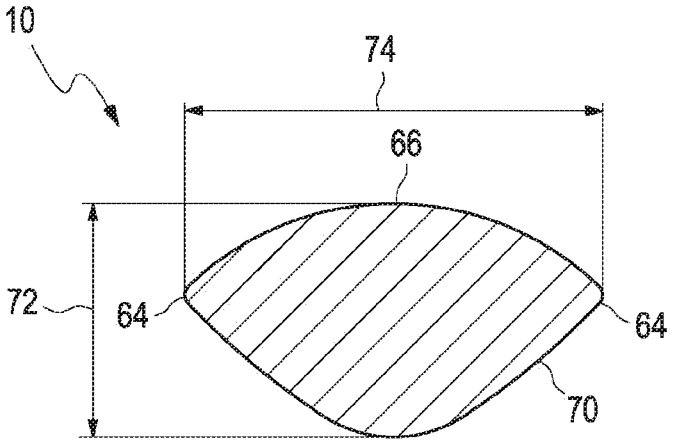

FIGS. 29 to 31 show different cross-sections of a treatment a stick 10.

In FIG. 29 different radii in a section of a tissue treatment stick are shown in a sectional view, namely two edges-forming radii 64 of 2 mm, a radius 66 of 20 mm, a radius 68 of 9.5 mm and a radius 70 of 100 mm. The treatment stick has a height 72 of 18.2 m and a width 74 of 28.8 mm.

In FIG. 30 different radii in a section of an alternative tissue treatment stick 10 having disposed therein a vibration motor 18 are shown in a sectional view, namely edge-forming radii 64 of 2 mm, a radius 66 of 35 mm and a radius 70 of 177 mm. The treatment stick has a height 72 of 32 mm and a width 74 of 52 mm.

In FIG. 31 different radii in a section of a further tissue treatment stick 10 having disposed therein a vibration motor 18 are shown in a sectional view, namely edge-forming radii 64 of 4 mm, a radius 66 of 39 mm and a radius 70 of 194 mm. The treatment stick has a height 72 of 35 mm and a width 74 of 57 mm.

In general it may be preferred to define an edge or an edge-forming radius as follows:

An edge-forming radius or an edge has a cross-sectional radius smaller by at least a factor of 3, preferably at least a factor of 5, more preferably at least a factor of 10, more preferably at least a factor of 15, than any radius of two sections directly adjacent to the edge-forming radius or directly adjacent to the edge.

In the embodiment shown in FIG. 29 radius 64 of 6.66 mm is by definition still to be regarded as an edge-forming radius or as an edge 24, because the section adjacent to it has as smallest radius of 20 mm. The definition can yet be limited as follows: The smallest radius of a section adjacent to an edge-forming radius is always greater than 15 mm.

Figure 32:
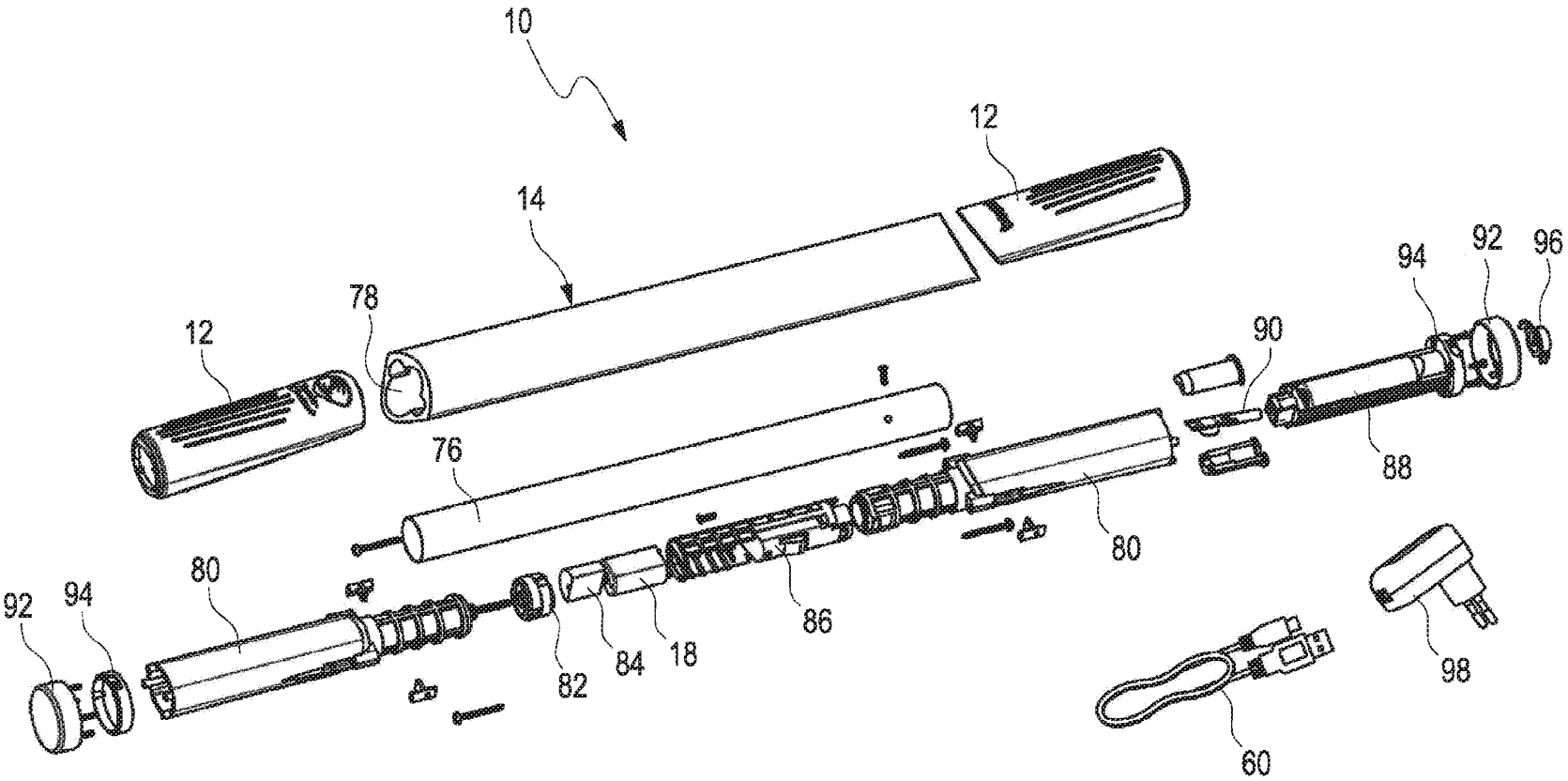
FIG. 32 shows an exploded view of a treatment stick.

FIG. 32 is an exploded view of a treatment stick 10 having two handles 12 in the form of covers and a treatment section 14. A steel tube 76 is insertable into an opening 78 of the treatment section 14. Into the steel tube 76 are insertable the grips 80, a locking device 82, an eccentric unit 84 for producing the vibration movement, a vibration motor 18, a motor mount 86. On the right side a battery holder 88 with a plug-in contact 90 is also shown, which can be slid into or stuck through the grip 80 shown to the right. On either side of the treatment stick 10 a cover 92 is shown with bracket 94, wherein an actuating device 96 is disposed in one of the covers 92. By means of the actuating device 96, the motor 18 of the treatment stick can be turned on and off. Finally, a power supply unit 98 and a USB connector 60 for power supply or for recharging a battery of the treatment stick 10 is shown.

Figure 33:
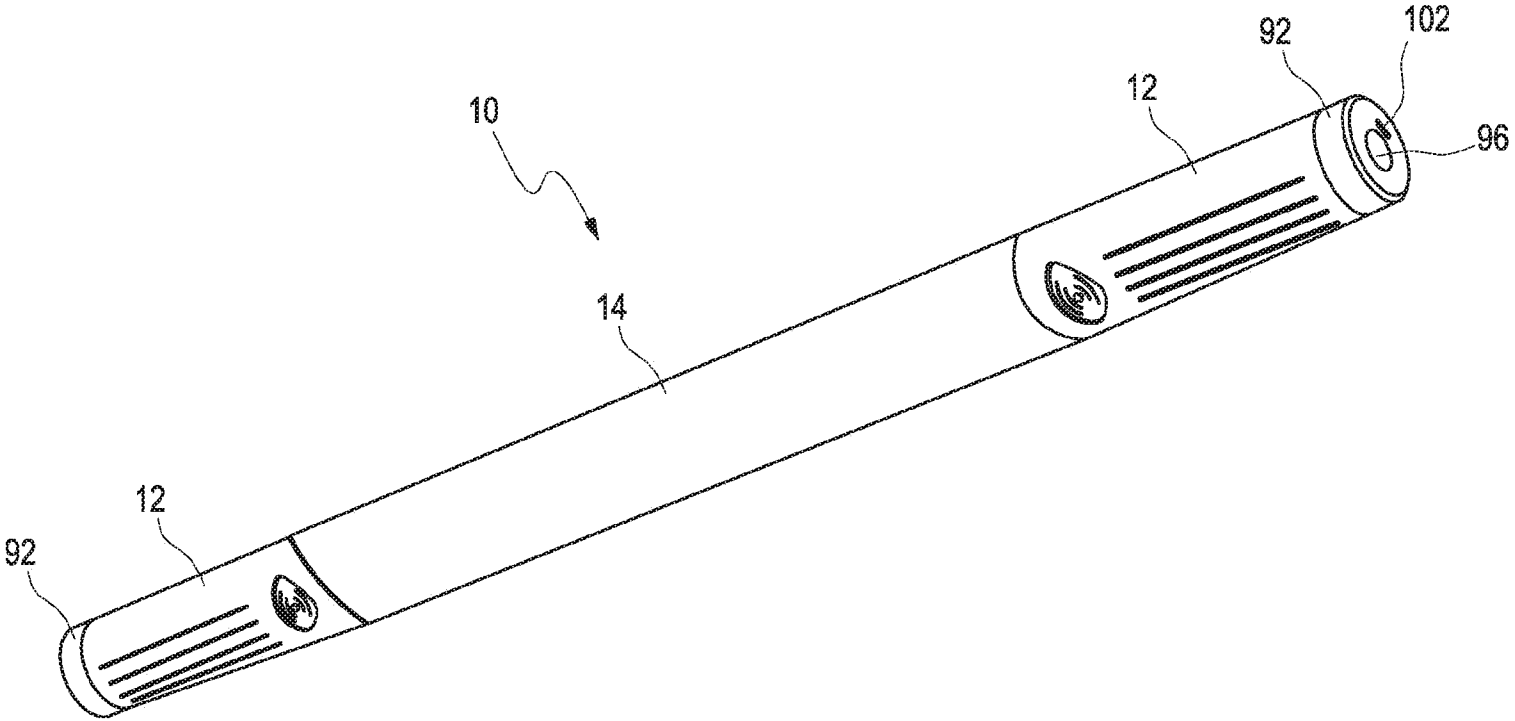
FIG. 33 shows a perspective view of a treatment stick.

FIG. 33 is an isometric view of a treatment stick according to FIG. 33, wherein in addition a USB socket 102 is shown, with which the power supply unit 98 or other devices can be connected.

Figure 34:
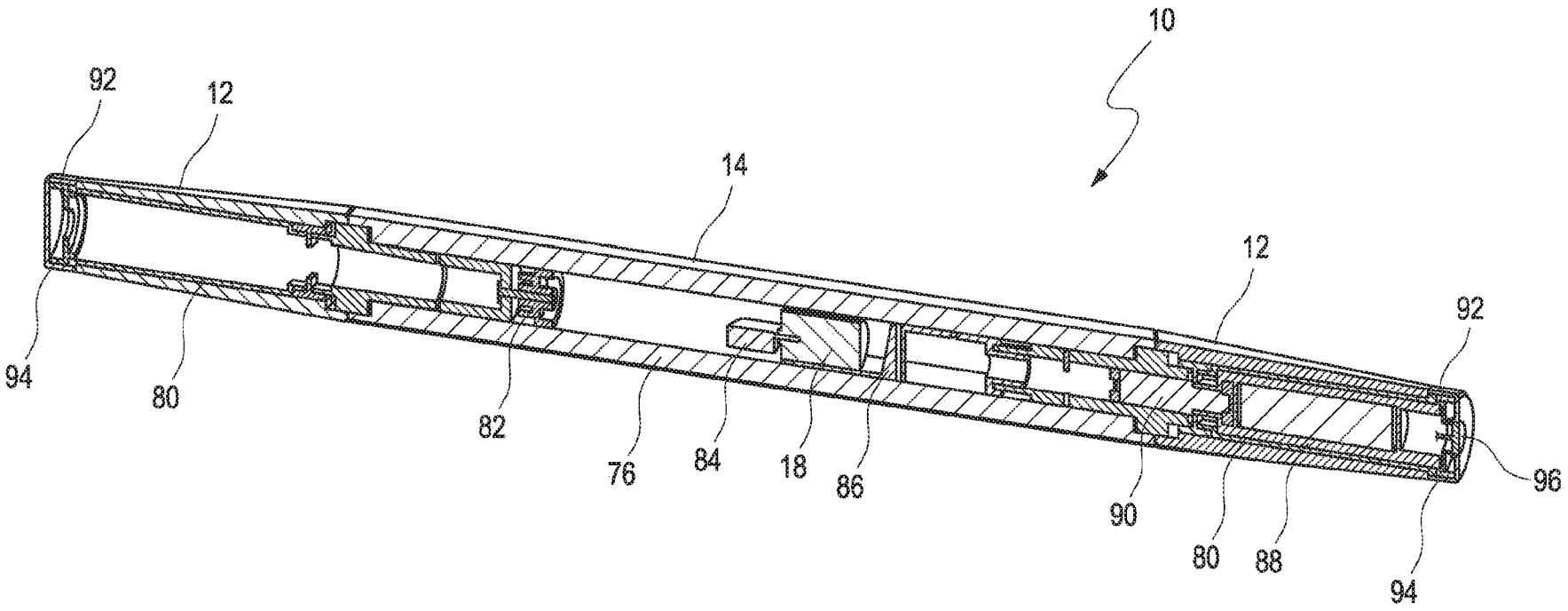
FIG. 34 shows a sectional view of a treatment stick according to FIG. 33.
Figure 35:
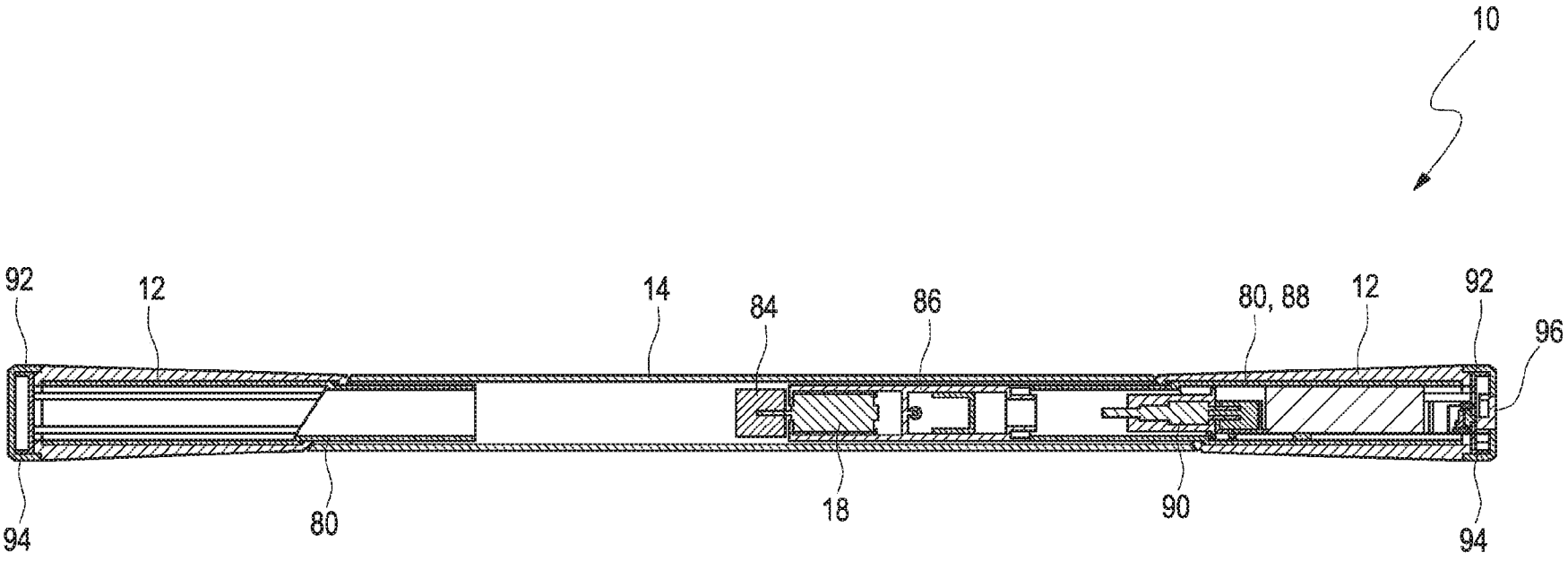
FIG. 35 shows a sectional view of an alternative treatment stick.

FIG. 34 is a sectional view of a treatment stick according to FIG. 33 and FIG. 35 shows a sectional view of an alternative treatment stick 10 which tapers from the outside inwards.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

LIST OF REFERENCE NUMERALS

10 tissue treatment stick
12 handle
14 treatment section
16 arrow
18 vibrations
18 vibration motor
20 receptacles
22 cover
24 edge
26 edge
28 edge
30 ribs
32 force measuring devices
34 movement
36 axis
38 angle
39 front side
40 end section
42 angle
44 joint
46 axis of rotation
48 plastic material
50 section
52 light source
54 heating unit
56 insulation
58 protective layer
60 USB connector
62 hand-held device
64-70 radius

72 height
74 width
76 steel tube
78 opening
80 grips
82 locking device
84 eccentric unit
86 motor mount
88 battery holder
90 plug-in contact
92 cover
94 bracket
96 actuating device
68 power supply unit
102 USB socket
164 internet cloud
166 communication interface

The invention claimed is:

1. A tissue treatment stick comprising:

a treatment section comprising a vibration motor; and at least two handles, wherein the treatment section is disposed between the two handles, wherein the treatment section has at least two and at most three edges, the edges extending parallel to a longitudinal axis of the tissue treatment stick, wherein the edges have an edge-forming cross-sectional radius of curvature smaller by at least a factor of 3 than any radius of curvature of two sections directly adjacent to the edge-forming cross-sectional radius, wherein the vibration motor is configured to:

generate a directed oscillating movement of the treatment section, and cause the treatment section to vibrate, wherein a direction of the oscillating movement extends radially from a center point of the treatment section through the edges, wherein a first edge of the edges is made of wood, and wherein a second edge of the edges is made of a rubber-elastic material.

2. The tissue treatment stick according to claim 1, wherein the edges comprise a third edge, and wherein the third edge comprises ribs.

3. The tissue treatment stick according to claim 1, wherein at least one edge of the edges is removable.

4. The tissue treatment stick according to claim 1, further comprising a sensor configured to detect a force applied to a connective tissue, a muscle, muscle fasciae or tendons to be treated via the treatment section by the two handles.

* * * * *